US008229329B2

(12) United States Patent
Imai

(10) Patent No.: US 8,229,329 B2
(45) Date of Patent: Jul. 24, 2012

(54) DEVELOPER CARTRIDGE INCLUDING SHUTTER FOR OPENING/CLOSING CASING AND LOCK MECHANISMS TO LOCK SHUTTER IN CLOSED POSITION USABLE WITH IMAGE FORMING DEVICE AND DEVELOPING DEVICE

(75) Inventor: Masashi Imai, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 12/718,241

(22) Filed: Mar. 5, 2010

(65) Prior Publication Data

US 2010/0247159 A1 Sep. 30, 2010

(30) Foreign Application Priority Data

Mar. 27, 2009 (JP) ..... 2009-078161

(51) Int. Cl.
*G03G 15/08* (2006.01)

(52) U.S. Cl. ..... 399/260

(58) Field of Classification Search ..... 399/262, 399/260, 258
See application file for complete search history.

(56) References Cited

U.S. PATENT DOCUMENTS

| | | | | |
|---|---|---|---|---|
| 5,614,996 | A | 3/1997 | Tanda | |
| 6,438,328 | B1 * | 8/2002 | Maltzahn et al. | 399/12 |
| 2003/0138272 | A1 * | 7/2003 | Nagashiro | 399/258 |
| 2007/0237551 | A1 * | 10/2007 | Kawai | 399/258 |

FOREIGN PATENT DOCUMENTS

| | | | |
|---|---|---|---|
| JP | 08-062979 | | 3/1996 |
| JP | 09-281784 | | 10/1997 |
| JP | 2006139072 | A * | 6/2006 |

* cited by examiner

*Primary Examiner* — Quana M Grainger
(74) *Attorney, Agent, or Firm* — Banner & Witcoff, Ltd.

(57) ABSTRACT

A developer cartridge includes a casing, a shutter, a first lock mechanism, and a second lock mechanism. The casing accommodates a developing agent therein and is formed with a supply opening. The shutter is movable between a closed position to close the supply opening and an open position to open the supply opening. The first lock mechanism locks the shutter at the closed position and unlocks the shutter to open the supply opening. The second lock mechanism is configured to lock the shutter at the closed position and be incapable of unlocking the shutter to maintain the closed position of the shutter.

12 Claims, 7 Drawing Sheets

DEVELOPER CARTRIDGE INCLUDING SHUTTER FOR OPENING/CLOSING CASING AND LOCK MECHANISMS TO LOCK SHUTTER IN CLOSED POSITION USABLE WITH IMAGE FORMING DEVICE AND DEVELOPING DEVICE

CROSS REFERENCE TO RELATED APPLICATION

This application claims priority from Japanese Patent Application No. 2009-078161 filed Mar. 27, 2009. The entire content of the priority application is incorporated herein by reference.

TECHNICAL FIELD

The present invention relates to a developer cartridge, an image forming device and a developing device.

BACKGROUND

In general, a toner cartridge (a developer cartridge) is detachably mounted in a main frame of an image forming device, such as a copier and a laser printer, in order to supply toner to a developing device. Such a developer cartridge includes a toner chamber formed with an opening for supplying toner to the developing device, a shutter movable between an open position and a closed position, and a lock mechanism to lock the shutter at the closed position.

It has been conventionally known a developer cartridge having a lock mechanism to lock a shutter with a movable lock pin provided in a toner container. The lock pin is engageable with a through-hole formed on a side wall of the shutter so as to lock the shutter. In this lock mechanism, an unlock pin is provided in a main frame of an image forming device. When the developer cartridge is mounted in the main frame, the unlock pin is inserted into the through-hole to push the lock pin out of the through-hole to unlock the shutter. In association with rotation of the toner container, the shutter is relatively open. Therefore, the toner can be supplied from an opening formed in the toner container.

SUMMARY

In the above-described conventional developer cartridge, the shutter is likely to be unintentionally unlocked when a used developer cartridge is collected and the collected developer cartridge is transported. If the shutter is unlocked and open, the toner remaining in the used developer cartridge may be leaked through the opening.

In view of the foregoing, it is an object of the present invention to provide a developer cartridge capable of avoiding toner leakage when collecting and transporting the developer cartridge. Another object of the present invention is to provide an image forming device having the above-described developer cartridge. Still another object of the present invention is to provide a developing device in which the above-described developer cartridge is provided.

In order to attain the above and other objects, the present invention provides a developer cartridge including a casing, a shutter, a first lock mechanism, and a second lock mechanism. The casing accommodates a developing agent therein and is formed with a supply opening. The shutter is movable between a closed position to close the supply opening and an open position to open the supply opening. The first lock mechanism is configured to lock the shutter at the closed position and unlocks the shutter to open the supply opening. The second lock mechanism is configured to lock the shutter at the closed position and be incapable of unlocking the shutter to maintain the closed position of the shutter.

According to another aspect, the present invention provides an image forming device including a frame, the developer cartridge, a detecting unit, a moving unit, and a control device. The developer cartridge is detachably mounted on the frame. The detecting unit detects an amount of the developing agent in the casing. The moving unit forcibly moves the lock member from the stored position to the lock position. The control device determines whether the developer cartridge should be replaced by a new cartridge based on an output from the detecting unit, and drives the moving unit for moving the lock member from the stored position to the lock position when determining that the developer cartridge should be replaced.

According to still another aspect, the present invention provides a developing device including a device frame, the developer cartridge, and an operating portion. The developer cartridge is detachably mounted to the device frame. The operating portion acts on the second lock mechanism in association with the movement of the shutter from the closed position to the open position and allows the second lock mechanism to be moved from the stored position toward the lock position.

BRIEF DESCRIPTION OF THE DRAWINGS

The particular features and advantages of the present invention as well as other objects will become apparent from the following description taken in connection with the accompanying drawings, in which.

DETAILED DESCRIPTION

<General Structure of Laser Printer>

Next, a laser printer 1 as an image forming device according to one embodiment of the present invention will be described while referring to the accompanying drawings.

Throughout the specification, the terms "above", "below", "right", "left", "front", "rear" and the like will be used assuming that the laser printer 1 is disposed in an orientation in which it is intended to be used. More specifically, in FIG. 1 a left side and a right side are a rear side and a front side, respectively. Further, in FIG. 1 a near side and a far side are a left side and a right side, respectively.

Figure 1:
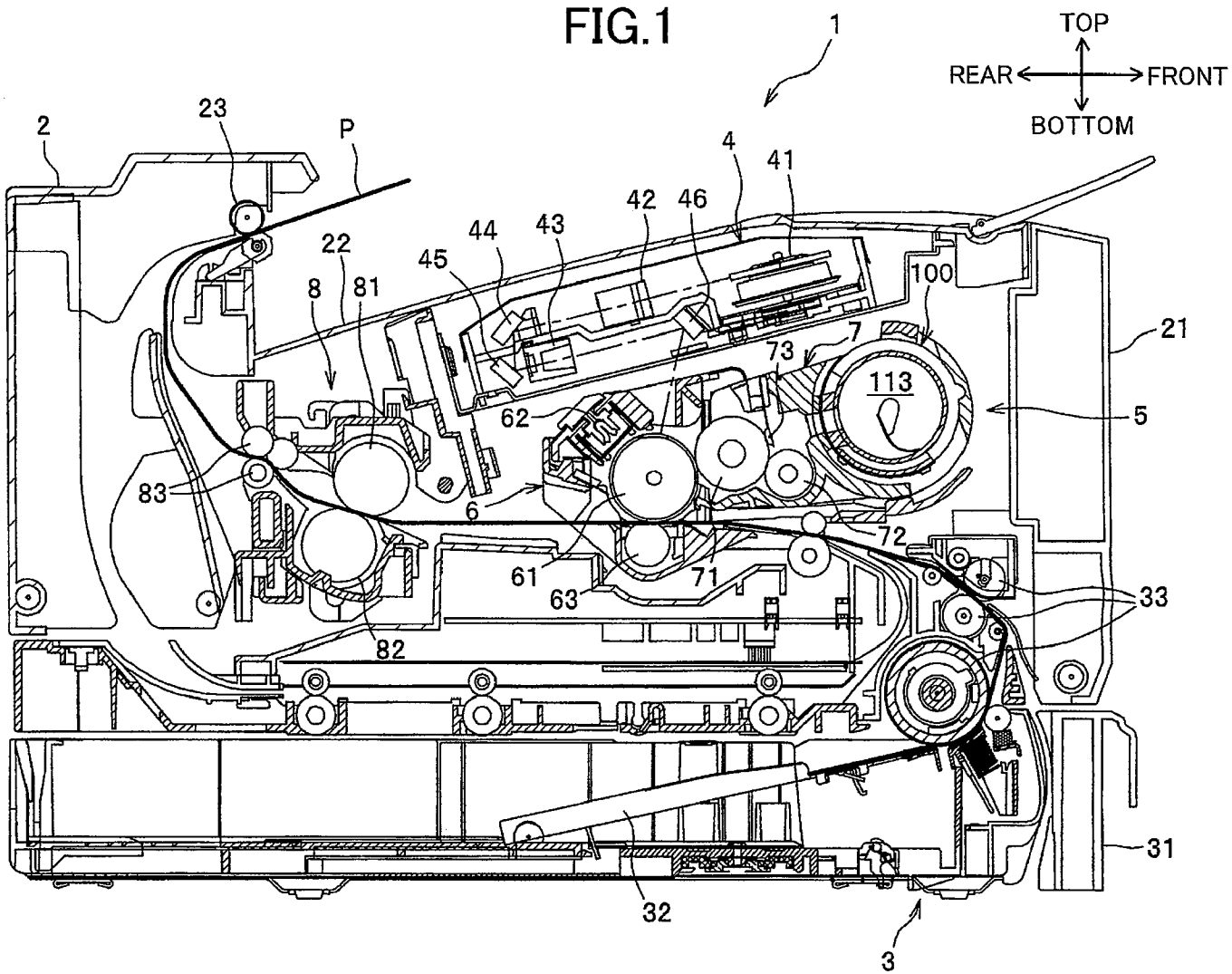
FIG. 1 is a schematic cross-sectional view of a laser printer embodying an image forming device according to one embodiment of the present invention.

As shown in FIG. 1, the laser printer 1 has a main casing 2. Within the main casing 2, a sheet supply section 3 for supplying a sheet P, an exposure device 4, a process cartridge 5 for transferring a toner image on the sheet P, and a fixing device 8 for thermally fixing the transferred toner image on the sheet P by heat are provided.

The sheet supply section 3 is disposed at a lower portion of the main casing 2. The sheet supply section 3 mainly includes a sheet supply tray 31 for accommodating the sheet P, a paper pressing plate 32 for urging a front edge portion of the sheet P upward, and various rollers 33 for conveying the sheet P, separating the sheet P, and collecting paper dust. Each sheet P accommodated in the sheet supply tray 31 is directed upward by the paper pressing plate 32 and conveyed toward the process cartridge 5 by the rollers 33.

The exposure device 4 is disposed at an upper portion of the main casing 2. The exposure device 4 mainly includes a laser emission unit (not shown), a polygon mirror 41 that is drivingly rotatable, lenses 42 and 43, and reflecting mirrors 44, 45, and 46. A laser beam (shown by a dotted chain line in FIG. 1) based on image data is emitted from the laser emission unit, and is reflected by or passes through the polygon mirror 41, the lens 42, the reflecting mirrors 44 and 45, the lens 43, and the reflecting mirror 46 in this order. A surface of a photosensitive drum 61 is subjected to high speed scan of the laser beam.

The process cartridge 5 is disposed below the exposure device 4. The process cartridge 5 is detachable relative to the main casing 2 through a front opening after pivotally opening a front cover 21 provided in the main casing 2. The process cartridge 5 is provided with a photosensitive cartridge 6, a developing cartridge 7 and a toner box 100.

The photosensitive cartridge 6 mainly includes the photosensitive drum 61, a charger 62, and a transfer roller 63. The developing cartridge 7 is detachably assembled to the photosensitive cartridge 6. The developing cartridge 7 mainly includes a developing roller 71, a supply roller 72, and a layer thickness regulating blade 73.

The toner box 100 is detachably assembled to the developing cartridge 7. The toner box 100 which constitutes a part of the process cartridge 5 is detachably mounted in the main casing 2. The toner box 100 has a toner chamber 113 for accommodating toner therein. A structure of the toner box 100 will be described later in detail.

In the process cartridge 5, after the surface of the photosensitive drum 61 is uniformly charged by the charger 62, the surface is exposed to laser beam from the exposure device 4 with a high speed scan. An electrostatic latent image is thereby formed on the photosensitive drum 61 based on the image data. The toner accommodated in the toner chamber 113 is supplied to the developing roller 71 via the supply roller 72. The toner is conveyed between the developing roller 71 and the layer thickness regulating blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image can be formed on the photosensitive drum 61. The sheet P is conveyed between the photosensitive drum 61 and the transfer roller 63, so that the toner image formed on the photosensitive drum 61 is transferred onto the sheet P.

The fixing device 8 is disposed rearward of the process cartridge 5. The fixing device 8 mainly includes a heating roller 81, a pressure roller 82 that pinches the sheet P with the heating roller 81, and conveying rollers 83 for conveying the sheet P having a fixed toner image. While the sheet P onto which the toner image is transferred is conveyed between the heating roller 81 and the pressure roller 82, the toner image is thermally fixed on the sheet P by heat. The sheet P on which the toner image is thermally fixed is discharged to a discharge tray 22 by the conveying rollers 83 and discharge rollers 23.

<Detailed Structure of Toner Box>

Figure 2:
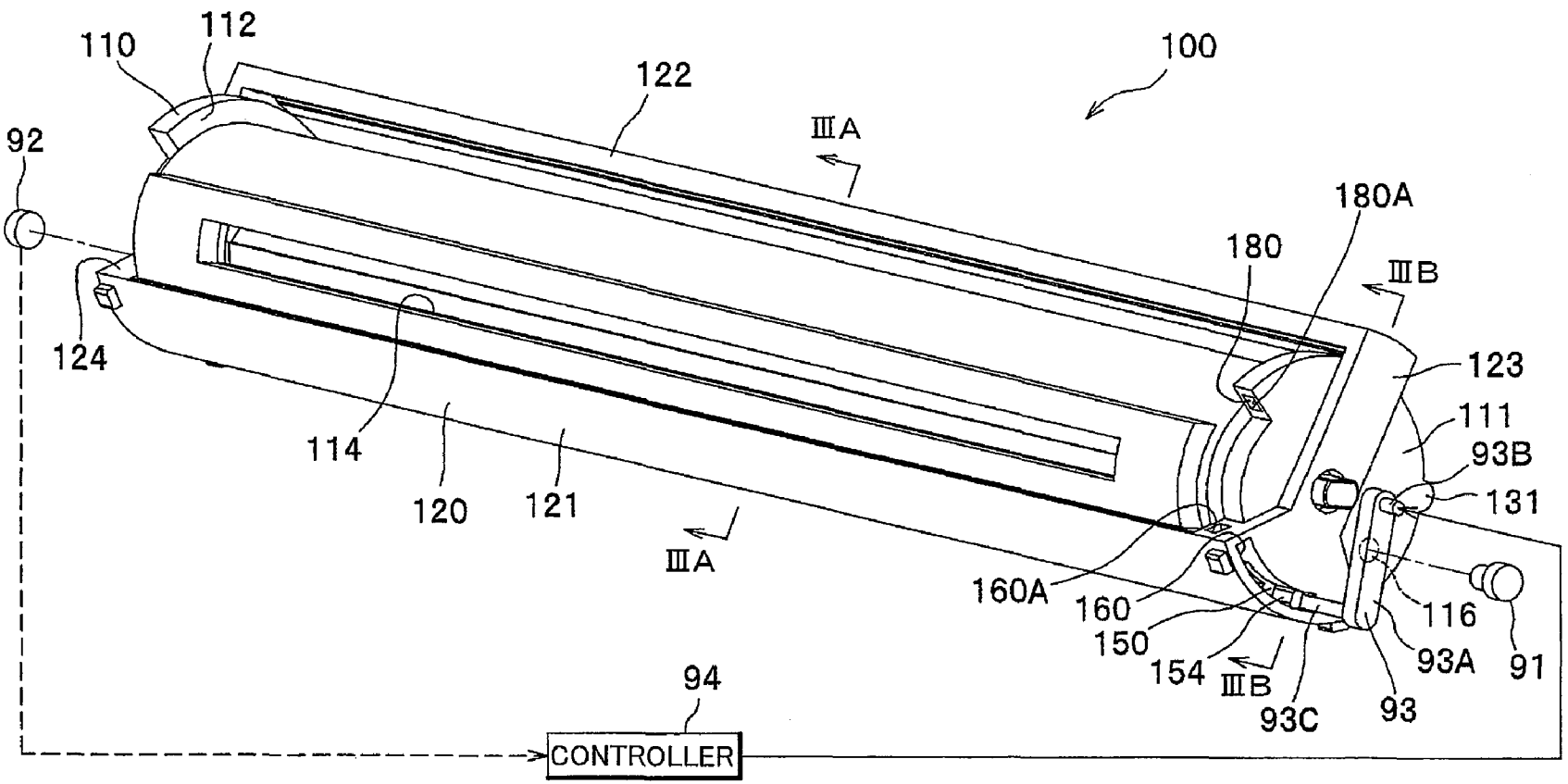
FIG. 2 is a perspective view of a toner box embodying a developer cartridge according to the embodiment of the present invention.
Figure 3A:
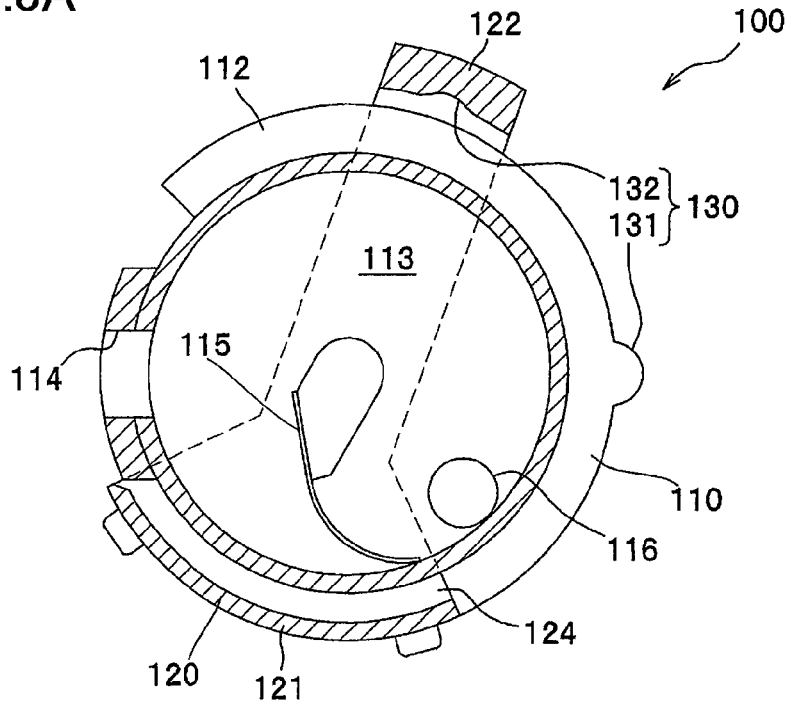
FIG. 3A is a cross-sectional view of the toner box taken along a line IIIA-IIIA in FIG. 2.
Figure 3B:
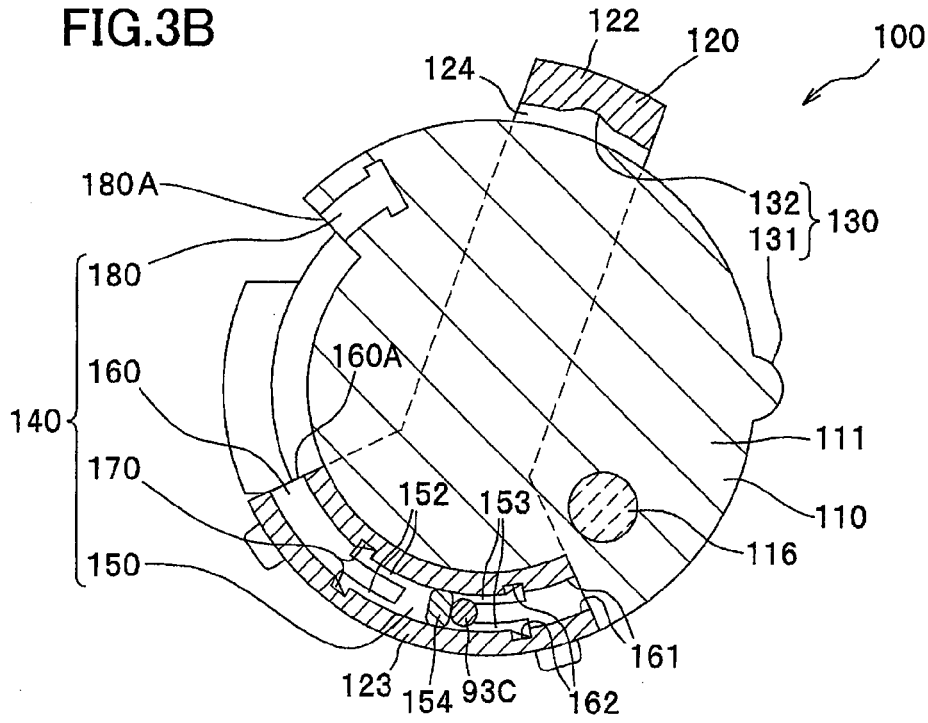
FIG. 3B is a cross-sectional view of the toner box taken along a line IIIB-IIIB in FIG. 2.

Next, a structure of the toner box 100 will be described in detail. As shown in FIGS. 2, 3A and 3B, the toner box 100 mainly includes a casing 110, a shutter 120, a first lock mechanism 130, and a second lock mechanism 140.

[Structure of Casing and Shutter]

The casing 110 is generally in a form of a cylindrical shape having side walls 111 and 112 at its ends to form the toner chamber 113 accommodating the toner therein. A cylindrical wall of the casing 110 is formed with a supply opening 114. The supply opening 114 has a generally rectangular shape extending in a longitudinal direction of the casing 110. The toner accommodated in the toner chamber 113 is supplied to the supply roller 72 (shown in FIG. 1) through the supply opening 114.

The toner chamber 113 is provided with an agitator 115. A drive force from a motor (not shown) provided in the main casing 2 rotates the agitator 115 in a clockwise direction in FIG. 3A. While agitating the toner accommodated in the toner chamber 113, the agitator 115 conveys the toner toward the supply opening 114.

The shutter 120 is so configured as to be pivotally movable between an open position (FIGS. 3A and 3B) that opens the supply opening 114 and a closed position (FIGS. 4A and 4B) that closes the supply opening 114. The shutter 120 mainly includes a shutter section 121, an operating section 122, and connecting sections 123 and 124.

The shutter section 121 has a generally arcuate shape in cross-section, and opens and closes the supply opening 114. The operating section 122 is disposed at a side opposite to the shutter section 121 relative to the casing 110. The connecting sections 123 and 124 are provided at the respective ends of the casing 110 for connecting the shutter section 121 to the operating section 122.

Basically, after assembling the toner box 100 to the developing cartridge 7, a user who uses the laser printer 1 operates the operating section 122 to pivotally move the shutter section 121. The shutter 120 is thereby moved to the open position from the closed position. Then, the user mounts the toner box 100 in the laser printer 1.

[Structure of First Lock Mechanism]

Figure 4A:
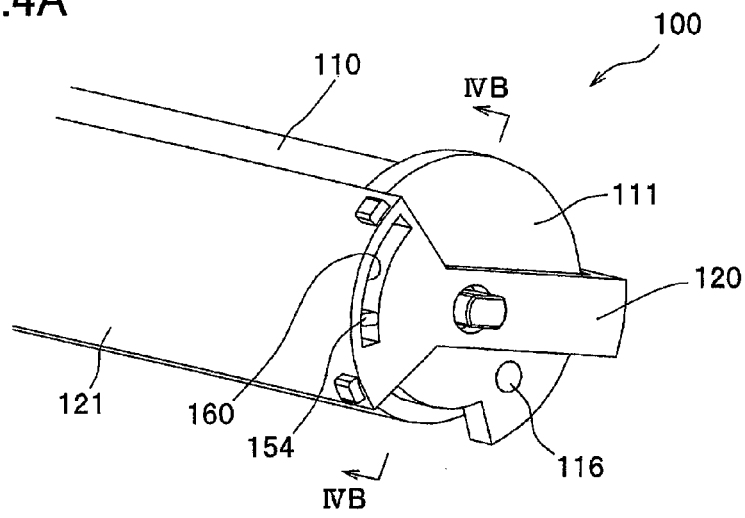
FIG. 4A is a perspective view of the toner box according to the embodiment when a shutter is locked by a first lock mechanism.
Figure 4B:
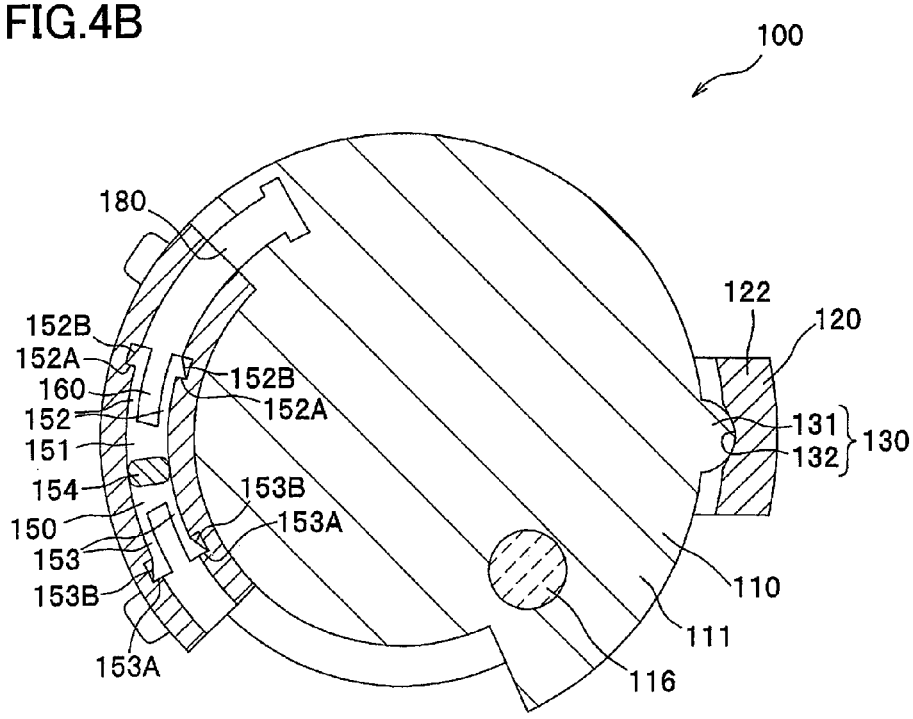
FIG. 4B is a cross-sectional view of the toner box taken along a line IVB-IVB in FIG. 4A.

As shown in FIGS. 3A and 3B, the first lock mechanism 130 serves as a mechanism for locking the shutter 120 at the closed position (shown in FIGS. 4A and 4B). The first lock mechanism 130 includes first convex portions 131 formed in the casing 110 and a first concave portion 132 formed in the shutter 120. More specifically, the first convex portions 131 are provided at the side walls 111 and 112 respectively and at a position in opposition to a position at which the supply opening 114 is formed. Each of the first convex portions 131 protrudes outwardly so as to form a semicircular-shape. The first concave portion 132 having an arcuate-shape in cross-section is formed in the operating section 122 and in confrontation with the casing 110.

As shown in FIGS. 4A and 4B, when the shutter 120 is moved in one direction to the closed position, the first concave portion 132 is brought into engagement with the first convex portions 131. Therefore, the shutter 120 can be locked at the closed position. Further, pivotal movement of the shutter 120 in opposite direction enables the first concave portion 132 to disengage from the first convex portions 131. Accordingly, the first lock mechanism 130 is configured such that the shutter 120 can be unlocked.

[Structure of Second Lock Mechanism]

Figure 6A:
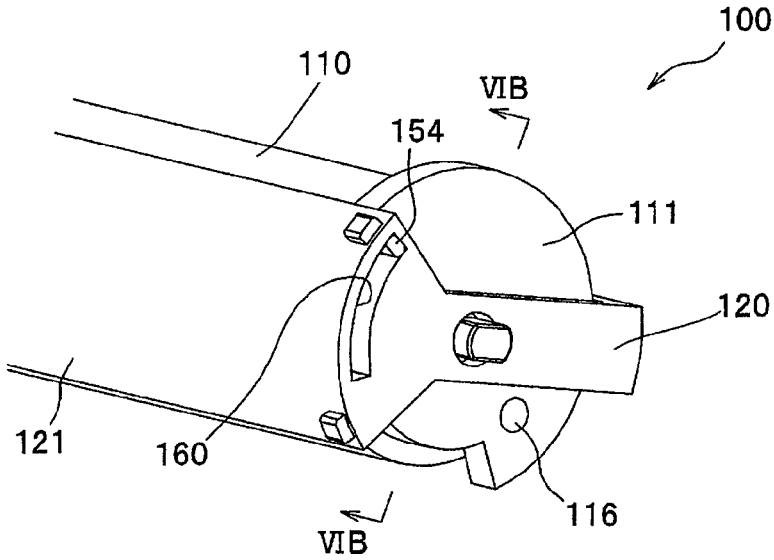
FIG. 6A is a perspective view of the toner box according to the embodiment when the shutter is locked by a second lock mechanism.
Figure 6B:
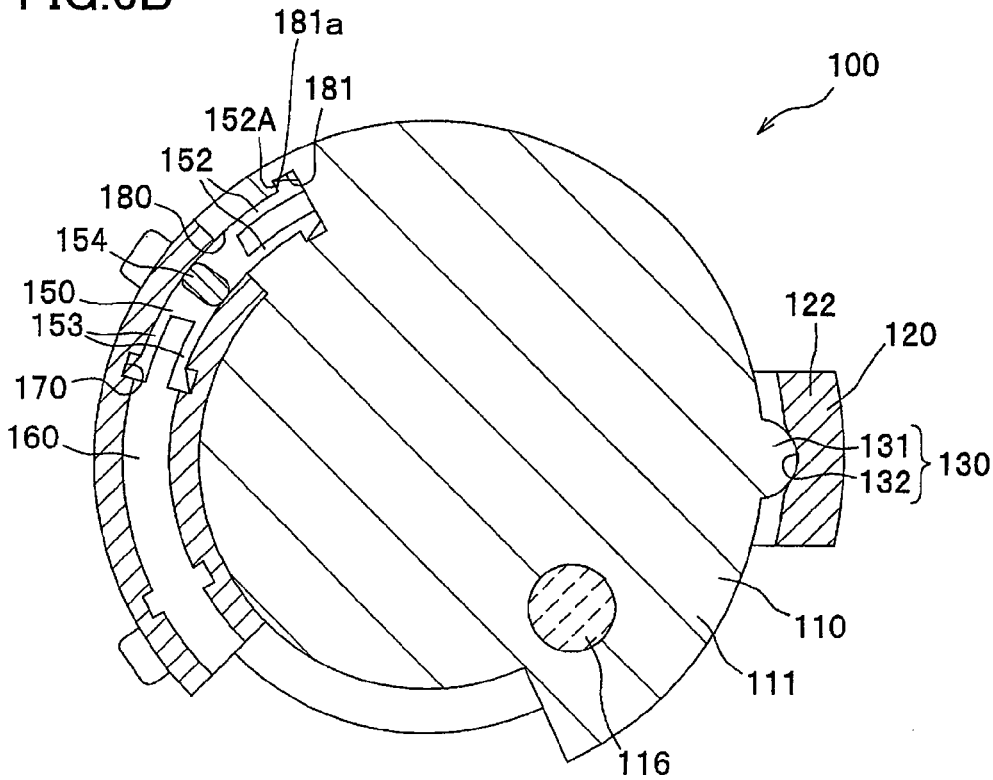
FIG. 6B is a cross sectional view of the toner box taken along a line VIB-VIB in FIG. 6A.

The second lock mechanism 140 serves as a mechanism for ensuring a lock of the shutter 120 at the closed position (shown in FIGS. 6A and 6B). The second lock mechanism 140 includes a lock member 150 provided at the shutter 120, a storage portion 160 formed in the shutter 120, and a second concave portion 170 formed in the shutter 120, and a recessed engagement portion 180 formed in the casing 110. Here, in the following description, a direction along the circumferential surface of the casing 110 will be referred to as a "circumferential direction" and a radial direction of the casing 110 will be simply referred to as a "radial direction."

(Structure of Lock Member)

As shown in FIGS. 4A and 4B, the lock member 150 includes a generally sector-shaped base portion 151, a pair of first engagement parts 152, a pair of second engagement parts 153, and an operated portion 154.

The base portion 151 has one circumferential end from which the pair of the first engagement parts 152 integrally extends in one circumferential direction. Specifically, the first engagement parts 152 are arranged spaced apart from each other in the radial direction and are resiliently deformable so as to be bent closer to each other. Further, each of the first engagement parts 152 has a free end portion provided with a lock portion including a lock surface 152A and a first slant surface 152B.

The lock surfaces 152A, 152A are aligned with each other in the radial direction and extend away from each other. One of the first slant surfaces 152B diagonally extends from a radially outer edge of the lock surface 152A so that a thickness of one of the lock portions is gradually reduced toward its free end. Remaining one of the first slant surfaces 152B diagonally extends from a radially inner edge of the lock surface 152A so that a thickness of the other lock portion is gradually reduced toward its free end.

The pair of the second engagement parts 153 integrally extends from another circumferential end of the base portion 151 in an opposite circumferential direction relative to the first engagement parts 152. Specifically, the second engagement parts 153 are arranged spaced apart from each other in the radial direction and are resiliently deformable so as to be bent closer to each other. Further, each of the second engagement parts 153 has a free end portion provided with an engagement portion including an end surface 153A and a second slant surface 153B.

Circumferentially free ends of the engagement portions define the end surfaces 153A, 153A aligned with each other in the radial direction. Each second slant surface 152B diagonally extends so that a thickness of each engagement portion is gradually increased toward each end surface 153A.

The operated portion 154 protrudes outwardly in the longitudinal direction of the casing 110 from the base portion 151. According to the present embodiment, the operated portion 154 is pressed by a drive arm 93 (shown in FIG. 2) described later, so that the lock member 150 is moved to a lock position as shown in FIGS. 5A and 5B from a stored position as shown in FIGS. 2 and 3B.

(Structure of Storage Portion and Second Concave Portion)

As shown in FIGS. 2 and 3B, the storage portion 160 is a groove having an arcuate shape, as viewed from a left side of the casing 110, and formed in the connecting section 123. An opening 160A to allow the lock member 150 to protrude therefrom is formed in one end of the storage portion 160 in the circumferential direction. The storage portion 160 stores the lock member 150 therein. In the storage portion 160, the lock member 150 is slidingly movable in the circumferential direction (in the clockwise direction in FIG. 3B).

Figure 5A:
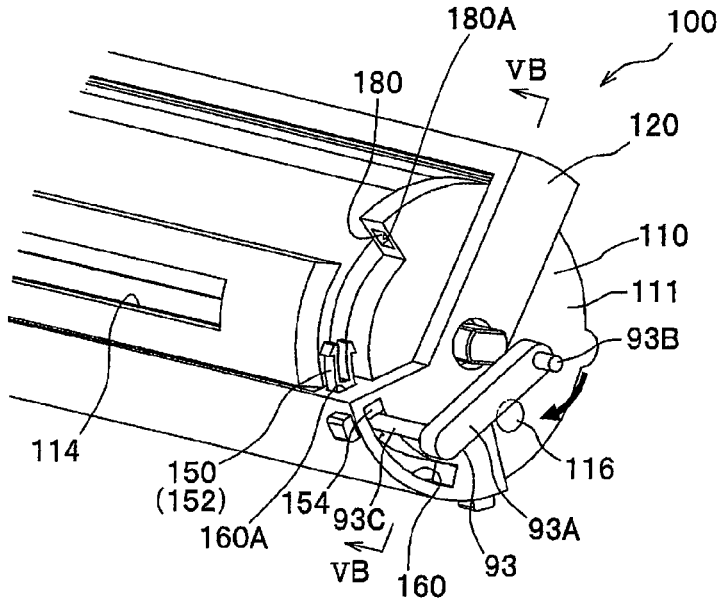
FIG. 5A is a perspective view of the toner box in which a lock member is moved to a lock position according to the embodiment.
Figure 5B:
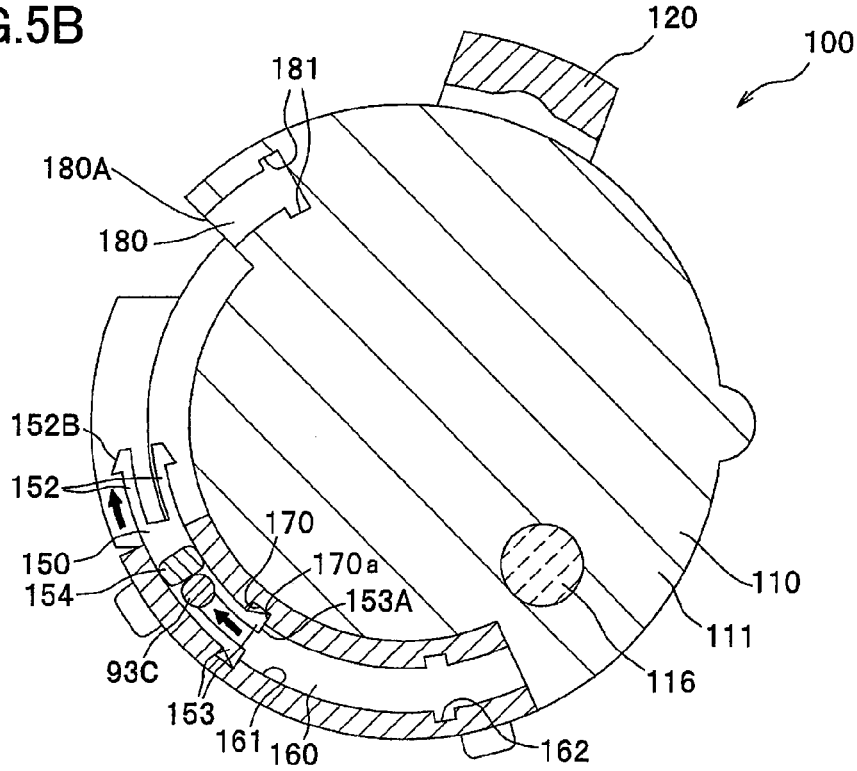
FIG. 5B is a cross-sectional view of the toner box taken along a line VB-VB in FIG. 5A.

More specifically, the lock member 150 is movable between the stored position and the lock position (shown in FIGS. 5A and 5B). At the stored position, the entire portion of the lock member 150 is stored in the storage portion 160 so that the shutter 120 cannot be locked. At the lock position, the first engagement parts 152 protrude in the circumferential direction from the storage portion 160 through the opening 160A toward the recessed engagement portion 180 so that the shutter 120 can be locked by the lock member 150.

The storage portion 160 is defined by inner surfaces 161 facing each other. The inner surfaces 161 are formed with a pair of rectangular second concave portions 170 and a pair of rectangular third concave portions 162. Each engagement portion of the second engagement parts 153 (the end surface 153A and the second slant surface 153B) is engageable with the third concave portion 162 when the lock member 150 is in the stored position.

The pair of the second concave portions 170 fix the lock member 150 to the lock position. Specifically, when the lock member 150 is at the stored position, each lock portion of the first engagement parts 152 (the lock surface 152A and the first slant surface 152B) is in engagement with the second concave portion 170. As shown in FIG. 5B, when the lock member 150 is moved to the lock position, each engagement portion of the second engagement parts 153 (the end surface 153A and the second slant surface 153B) is brought into engagement with the second concave portion 170.

Each of the second concave portions 170 has a surface 170*a* extending in the direction perpendicular to the circumferential direction. Here, both the end surfaces 153A and the surfaces 170*a* extend in the direction perpendicular to the circumferential direction. When a force (a force acting in a counterclockwise direction in FIG. 5B) is applied to the lock member 150 to move the lock member 150 toward the stored position after engagement of the second concave portions 170 with the second engagement parts 153, each of the end surfaces 153A is brought into abutment with the surface 170*a*. Since the abutment of the end surface 153A with the surface 170*a* prohibits movement of the lock member 150 toward the stored position, the lock member 150 can be fixed to the lock position.

Although it is not shown in the drawings, while the lock member 150 is moved within the storage portion 160 from the stored position toward the lock position, the first engagement parts 152 are urged so as to be deformed or bent closer to each other and the second engagement parts 153 are also urged so as to be deformed or bent closer to each other. More specifically, when the lock member 150 starts to be moved from the stored position shown in FIGS. 2 and 3B toward the lock position shown in FIG. 5B, the first slant surfaces 152B and the second slant surfaces 153B (shown in FIG. 4B) are pressed by an edge of the second concave portions 170 and an edge of the third concave portions 162, respectively. Each of the first engagement parts 152 and each of the second engagement parts 153 are gradually deformed. When being deformed by a predetermined amount, the first engagement parts 152 and the second engagement parts 153 are disengaged from the second concave portions 170 and the third concave portions 162, respectively.

Then, the lock member 150 is moved toward the lock position while the first engagement parts 152 and the second engagement parts 153 are maintained in the deformed state. As shown in FIG. 5B, each of the first engagement parts 152 restores their inherent linearity upon protruding outwardly from the storage portion 160. Each of the second engagement parts 153 restores their inherent linearity upon the engagement portions of the second engagement parts 153 being brought into engagement with the second concave portions 170.

According to the present embodiment, when the lock member 150 is at the stored position, the engagement portions of the second engagement parts 153 are brought into engagement with the third concave portions 162. Therefore, the third concave portions 162 prevent the second engagement parts 153 from being deformed, that is, the third concave portions 162 prevent the engagement parts 153 from their forcible deformation. While the lock member 150 is moved within the storage portion 160, the second engagement parts 153 are urged to be bent. Upon the engagement portions of the second engagement parts 153 reaching the second concave portions 170, the second engagement parts 153 reliably recover their original orientation. Since the abutment of the end surfaces 153A of the second engagement parts 153 with the surfaces 170*a* of the second concave portions 170 can be ensured, the lock member 150 can be reliably fixed to the lock position. That is, movement of the lock member 150 toward the stored position can be prohibited.

If the third concave portions 162 are not formed, the second engagement parts 153 are constantly bent until the lock member 150 is moved to the lock position. Even if the second engagement parts 153 can be brought into engagement with the second concave portions 170, the second engagement parts 153 cannot recover their original orientation due to bending fatigue. If this is the case, the end surfaces 153A of the second engagement parts 153 may not be properly abutted with the surfaces 170*a* of the second concave portions 170. Accordingly, the lock member 150 may not be fixed to the lock position.

A function to prevent the permanent deformation is also applicable to the second concave portions 170 with which the first engagement parts 152 are engageable when the lock member 150 is at the stored position. Here, in the present embodiment, the first engagement parts 152 are brought into engagement with the second concave portions 170 when the lock member 150 is at the stored position, so that the second concave portions 170 prevent the first engagement parts 152 from being plastically deformed. Further, the second engagement parts 153 are brought into engagement with the second concave portions 170 when the lock member 150 is at the lock position, so that the second concave portions 170 fix the lock member 150 to the lock position. That is, a simple construction can be provided in the present invention, since the second concave portions 170 can function not only to receive the lock portions (the lock surfaces 152A and the first slant surfaces 152B) of the first engagement parts 152 in the resting state but also to receive the engagement portions (the end surfaces 153A and the second slant surfaces 153B) of the second engagement parts 153 in the locking state.

(Structure of Recessed Engagement Portion)

As shown in FIGS. 5A and 5B, the recessed engagement portion 180 is formed in the side wall 111 of the casing 110. The recessed engagement portion 180 is provided at a position in confrontation with the opening 160A of the storage portion 160, or aligned with the first engagement parts 152 protruding from the opening 160A in the circumferential direction. The recessed engagement portion 180 is formed with a pair of fourth concave portions 181. Each of the fourth concave portions 181 is formed in a bottom end of the recessed engagement portion 180. The fourth concave portions 181 are in confrontation with each other in the radial direction and extend in a direction spaced away from each other.

Although it is not shown in the drawings, when the shutter 120 is moved toward the closed position, each of the first engagement parts 152 is brought into abutment with an opening 180A of the recessed engagement portion 180. Abutment of the first engagement parts 152 with the opening 180A urges the first slant surfaces 152B inward so that the first engagement parts 152 are bent closer to each other. While maintaining the bent state, the first engagement parts 152 are moved within the recessed engagement portion 180. At this time, the lock member 150 is fixed to the lock position by the second concave portions 170. Hence, even if the first slant surfaces 152B are pressed by the opening 180A, the lock member 150 is not pushed back into the storage portion 160.

As shown in FIGS. 6A and 6B, when the shutter 120 reaches the closed position, the lock portions of the first engagement parts 152 reach the fourth concave portions 181, and the first engagement parts 152 restores their original shape upon engagement with the fourth concave portions 181. The shutter 120 can be locked at the closed position by engaging the first engagement parts 152 with the fourth concave portions 181.

Each of the fourth concave portions 181 has a surface 181*a* extending in the direction perpendicular to the circumferential direction. Both the lock surfaces 152A and the surfaces 181*a* extend in the direction perpendicular to the circumferential direction. Even if a force is applied to move the shutter 120 to the open position after the first engagement parts 152 are brought into engagement with the fourth concave portions 181, the shutter 120 cannot be moved since the lock surfaces 152A are brought into abutment with the surfaces 181*a*. That is, abutment of the lock surfaces 152A with the surfaces 181*a* prevents the shutter 120 from moving to the open position. Therefore, the shutter 120 cannot be unlocked.

Further, except for the opening 180A to allow the first engagement parts 152 inserting thereinto, the recessed engagement portion 180 is formed in a completely enclosed shape. With this structure, the lock portions (the lock surfaces 152A and the first slant surfaces 152B) of the first engagement parts 152 in engagement with the fourth concave portions 181 are not accessible from an outside. Accordingly, disengagement of the first engagement parts 152 from the recessed engagement portion 180 (lock by the second lock mechanism 140) cannot be performed from the outside.

As described above, the second lock mechanism 140 is configured to maintain the locking state of the shutter 120. When the second lock mechanism 140 functions to lock the shutter 120 at the closed position, inherent function of the first lock mechanism 130 becomes unnecessary.

In the present embodiment, in the second lock mechanism 140, the lock member 150 is movable to the lock position from the stored position when desired. In other words, the second lock mechanism 140 is adapted to function when necessary. Accordingly, the first lock mechanism 130 and the second lock mechanism 140 can be used selectively.

<Detailed Structure of Laser Printer>

Next, a structure for driving the lock member 150 from the stored position to the lock position (to function the second lock mechanism 140) will be described. This driving structure is provided inside the laser printer.

As shown in FIG. 2, within the main casing 2 of the laser printer 1, a light emitting element 91 and a light receiving element 92, the drive arm 93, and a controller 94 for controlling an operation of the laser printer 1 are further provided.

To detect an amount of the toner accommodated in the toner box 100 mounted in the main casing 2, the light emitting element 91 and the light receiving element 92 are arranged so as to interpose a pair of light transmission windows 116 therebetween. The light transmission windows 116 are provided in the side walls 111 and 112 of the casing 110 respectively, and are in confrontation with each other. Light (indicated by a chain line in FIG. 2) emitted from the light emitting element 91 passes through one of the light transmission windows 116 to enter into the toner chamber 113. The light then passes through the other light transmission window 116, and is received by the light receiving element 92. The light receiving element 92 outputs to the controller 94 a light receiving signal according to an intensity of the received light (the intensity being indicative of the amount of the toner accommodated in the casing 110).

The drive arm 93 is a member to move the lock member 150 from the stored position to the lock position. The drive arm 93 is mainly provided with an arm portion 93A, a shaft 93B, and a pressing portion 93C. The arm portion 93A is disposed substantially parallel to the side wall 111. The shaft 93B extends from one end of the arm portion 93A outwardly in the longitudinal direction of the casing 110. The pressing portion 93C extends from another end of the arm portion 93A inwardly in the longitudinal direction of the casing 110.

When the toner box 100 of which the shutter 120 is at the open position is mounted in the process cartridge 5 and the process cartridge 5 is mounted in the main casing 2, the drive arm 93 is arranged such that a tip end of the pressing portion 93C is inserted into the storage portion 160 so as to be positioned beside the operated portion 154 of the lock member 150 at a side where the second engagement parts 153 is positioned.

The controller 94 includes a CPU, a RAM, a ROM, and an input-output circuit (not shown). In the present embodiment, the controller 94 determines by a well-known method a timing for replacement of the toner box 100 based on a program and data stored in the ROM and the output of the light receiving element 92 (data on the amount of the toner accommodated in the toner box 100).

As shown in FIGS. 5A and 5B, when determining that the toner box 100 needs to be replaced, the controller 94 provides the shaft 93B with a drive force by controlling a drive mechanism (not shown) to pivotally move the drive arm 93 (the pressing portion 93C) in a direction indicated by arrows in FIGS. 5A and 5B. Accordingly, the pressing portion 93C pushes the operated portion 154 of the lock member 150 towards the lock position. Thus, the lock member 150 can be moved from the stored position to the lock position.

<Operation>

Next, operation of the laser printer 1 and the toner box 100 will be described. Specifically, a series of operation from the time the new toner box 100 is mounted in the laser printer 1 until the used toner box 100 removed from the laser printer 1 is collected or transported will be described.

As shown in FIGS. 4A and 4B, in the new toner box 100, the shutter 120 is at the closed position and the lock member 150 is at the stored position. The shutter 120 is locked by only the first lock mechanism 130.

Initially, the toner box 100 is mounted in the developing cartridge 7. The operating section 122 is then manually operated to pivotally move the shutter section 121, thereby unlocking the shutter 120 locked by the first lock mechanism 130. The shutter 120 is moved from the closed position to the open position. Movement of the shutter 120 to the open position allows fluid communication between the toner chamber 113 and the developing cartridge 7 through the supply opening 114. Subsequently, the toner box 100 constituting a part of the process cartridge 5 is mounted in the main casing 2.

As shown in FIGS. 2 and 3B, upon assembly of the process cartridge 5 into the main casing 2, the toner box 100 is disposed between the light emitting element 91 and the light receiving element 92. The pressing portion 93C of the drive arm 93 is inserted into the storage portion 160 so as to be positioned beside the operated portion 154 at the side where the second engagement parts 153 is positioned. In this state, the laser printer 1 is capable of forming an image on the sheet P.

Even if the user removes the process cartridge 5 from the main casing 2 and closes the shutter 120 of the toner box 100 before the controller 94 determines that the toner box 100 needs to be replaced, the lock member 150 is still positioned at the stored position. Positioning of the lock member 150 at the stored position does not allow the second lock mechanism 140 to perform locking function, but only the first lock mechanism 130 performs locking function. Therefore, the shutter 120 can be re-opened. Thus, the toner box 100 can be used again as long as the toner remains therein after the toner box 100 is again mounted in the main casing 2.

As shown in FIGS. 5A and 5B, when the controller 94 determines that the toner box 100 needs to be replaced, the drive arm 93 is pivotally moved in the direction of the arrow so that the pressing portion 93C pushes the operated portion 154 of the lock member 150 toward the lock position. The lock member 150 is thereby moved from the stored position to the lock position, and the first engagement parts 152 protrude from the storage portion 160. Accordingly, the second lock mechanism 140 becomes operable. Then, the process cartridge 5 is removed from the main casing 2 to replace the toner box 100.

As shown in FIGS. 6A and 6B, when the shutter 120 is moved from the open position to the closed position, the first engagement parts 152 is brought into engagement with the recessed engagement portion 180. Thus, the shutter 120 is locked by the second lock mechanism 140. The second lock mechanism 140 is so configured as to be incapable of unlocking. Accordingly, the shutter 120 is not open while the used toner box 100 is collected or transported.

As described above, according to the toner box 100 in the present embodiment, making use of the second lock mechanism 140 prevents the shutter 120 from being unlocked unintentionally. Accordingly, toner leakage can be avoided when the used toner box 100 is collected or transported. Further, making use of the first lock mechanism 130 enables the shutter 120 to be unlocked even if the shutter 120 is closed while the toner box 100 is in use provided that the second lock mechanism 140 has not been moved to the lock position. Accordingly, the toner box 100 can be reused.

Further, the casing 110 is formed with the recessed engagement portion 180. The recessed engagement portion 180 is capable of locking the shutter 120 at the closed position by engaging with the first engagement parts 152 in such a manner that the first engagement parts 152 are not externally operable. That is, the recessed engagement portion 180 is a blind hole. The shutter 120 thus cannot be unlocked after having been locked by the second lock mechanism 140. Accordingly, the toner leakage from the used toner box 100 can be reliably avoided.

Further, when the controller 94 determines that the toner box 100 needs to be replaced, the laser printer 1 allows the drive arm 93 to move the lock member 150 from the stored position to the lock position. After the toner box 100 has been used, the laser printer 1 allows the second lock mechanism 140 to perform locking function. Accordingly, the toner leakage from the used toner box 100 can be avoided. Further, while the toner box 100 is in use, it is not the second lock mechanism 140 but the first lock mechanism 130 that can be operated. Therefore, the toner box 100 can be reused.

While the invention has been described in detail with reference to the embodiment thereof, it would be apparent to those skilled in the art that various changes and modifications may be made therein without departing from the spirit of the invention.

In the above-described embodiment, when the controller 94 determines that the toner box 100 needs to be replaced, the lock member 150 is moved from the stored position to the lock position by the drive arm 93. However, a member to move the lock member 150 from the stored position to the lock position can be provided in a developing cartridge 7A.

Figure 7A:
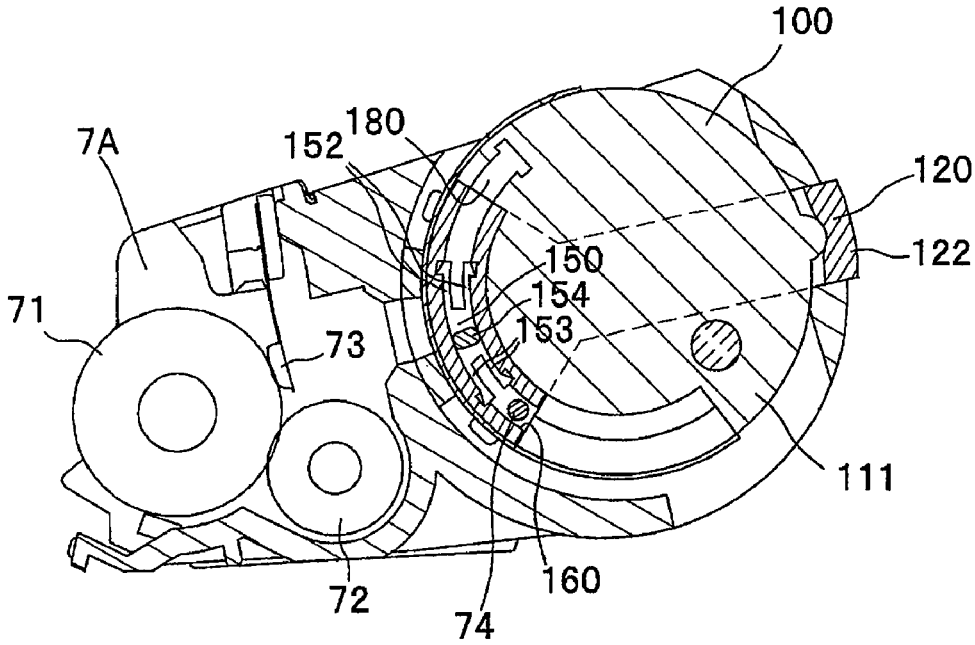
FIG. 7A is a cross-sectional view of a developing cartridge embodying a developing device and a toner box mounted in the developing cartridge in which a shutter is in a closed position.

In detail, as shown in FIG. 7A, the developing cartridge 7A is configured such that the toner box 100 is detachably mounted therein. In the same manner as the developing cartridge 7 in the above-described embodiment, the developing cartridge 7A is provided with the developing roller 71, the supply roller 72, and the layer thickness regulating blade 73. The developing cartridge 7A further includes an operating portion 74.

The operating portion 74 inwardly protrudes from an inner side surface of a frame of the developing cartridge 7A. When the toner box 100 in which the shutter 120 is at the closed position is mounted in the developing cartridge 7A, a tip end of the operating portion 74 is inserted into the storage portion 160. The tip end of the operating portion 74 is provided at a position adjacent to the operated portion 154 at the side where the second engagement parts 153 are positioned.

Figure 7B:
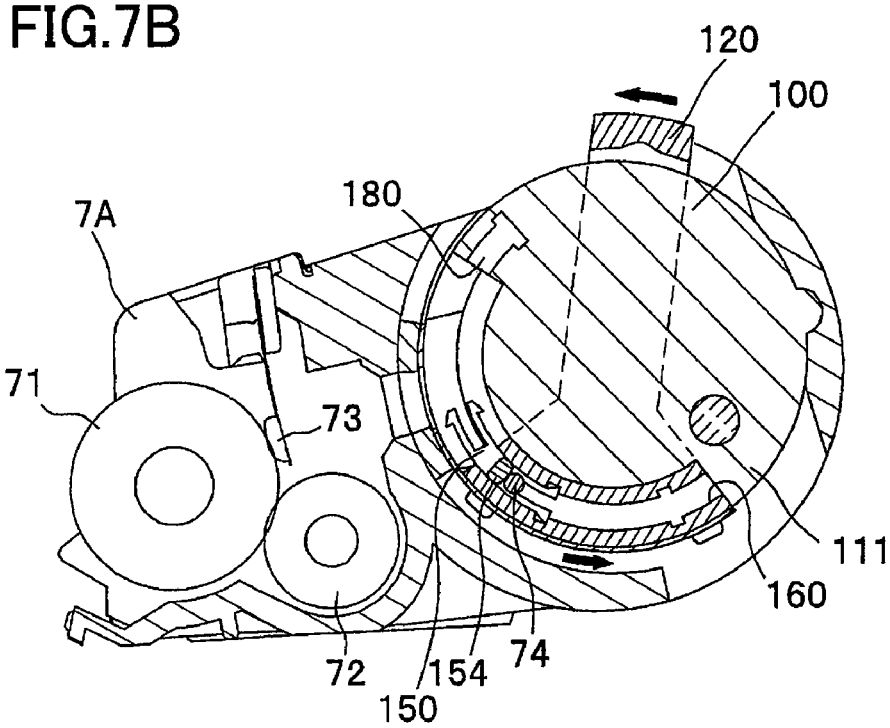
FIG. 7B is a cross-sectional view of the developing cartridge and the toner box mounted in the developing cartridge in which the shutter is in an open position.

As shown in FIG. 7B, pivotal movement of the shutter 120 from the closed position to the open position brings the operating portion 74 into abutment with the operated portion 154, and relatively moves the lock member 150 from the stored position to the lock position. That is, in this modification, the second lock mechanism 140 becomes operable in association with the operation that the toner box 100 is assembled to the developing cartridge 7A and that the shutter 120 is moved to the open position.

Compared to a case that the drive arm 93 and the drive mechanism for driving the drive arm 93 are provided in a main body of the image forming device, the structure of the image forming device can be simplified. Further, the present invention can be applied to an image forming device without the drive arm 93.

As described above, the developing cartridge 7A is illustrated as the developing device. However, the toner box 100 can be detachably mounted to a cartridge in which the developing cartridge 7A is formed integrally with the photosensitive cartridge 6 (not detachable).

In the above-described embodiment, the lock member 150 and the storage portion 160 are provided in the shutter 120, and the recessed engagement portion 180 is formed in the casing 110. However, the lock member 150 and the storage portion 160 can be provided in the casing 110, and the recessed engagement portion 180 can be formed in the shutter 120.

The above-described embodiment illustrates only one example of the structure of the second lock mechanism 140 (the lock member 150, the storage portion 160, the second concave portions 170, and the recessed engagement portion 180). However, instead of the second concave portions 170, movable pieces each biased by a spring are movably supported to the inner surfaces 161 of the storage portion 160, and engagement recesses are formed at the lock member 150 for engagement with the movable pieces. When the lock member 150 is moved to the lock position, the movable pieces can be brought into engagement with a concave portion formed in the lock member 150 by the biasing force of the spring so as to fix the lock member 150 to the lock position. Further, the storage portion 160 can be formed in a tubular shape so as to be capable of pushing the lock member 150 outward.

In the above described embodiment, the end surfaces 153A of the second engagement parts 153 and the surface 170*a* of the second concave portions 170 extend in a direction perpendicular to the circumferential direction. However, the end surfaces 153A of the second engagement parts 153 and the surfaces 170*a* of the second concave portions 170 can extend diagonally in a direction toward the opening 160A (shown in FIG. 3B) of the storage portion 160.

In the above described embodiment, the lock surfaces 152A of the first engagement parts 152 and the surfaces 181*a* of the fourth concave portions 181 extend in a direction perpendicular to the circumferential direction. However, the lock surfaces 152A of the first engagement parts 152 and the surfaces 181*a* of the fourth concave portions 181 can extend diagonally in a direction toward the bottom end in the recessed engagement portion 180.

In the above-described embodiment, the first lock mechanism 130 includes the first convex portion 131 provided at the casing 110 and the first concave portion 132 provided at the shutter 120. However, the first concave portion 132 can be formed in the casing 110, and the first convex portion 131 can be formed in the shutter 120.

Instead of the first convex portion 131 and the first concave portion 132, the first lock mechanism can be provided by resilient piece, such as a sponge, provided in at least either one of the casing 110 and the shutter 120 and disposed at a position between the casing 110 and the shutter 120 (the shutter at least at the closed position). Even with this arrangement, friction of the resilient piece is unlikely to move the shutter 120. Accordingly, the shutter 120 can be locked at the closed position.

The above-described embodiment illustrates only one example of the structures of the casing 110 and the shutter 120. In the above-described embodiment, the casing 110 is in a form of a cylindrical shape. However, the casing 110 can be formed in a box shape. Further, in the above-described embodiment, the shutter 120 is so configured as to be pivotally movable between the open position and the closed position. However, the shutter 120 can be configured to be linearly slidingly movable between the open position and the closed position.

The above-described embodiment illustrates only one example of the structures of the light emitting element 91, the light receiving element 92, and the drive arm 93. The light emitting element 91 and the light receiving element 92 can be replaced by a well-known detection unit if the amount of the developing agent in the casing can be detected.

In the above-described embodiment, the laser printer 1 is employed as the image forming device. However, an LED printer in which exposure is performed by an LED is also available. Further, a copier and a multifunction device other than a printer are also available.

What is claimed is:

1. A developer cartridge comprising:

a casing configured to accommodate a developing agent therein and formed with a supply opening;

a shutter movable between a closed position to close the supply opening and an open position to open the supply opening;

a first lock mechanism configured to lock the shutter at the closed position and unlock the shutter to open the supply opening; and, a second lock mechanism configured to lock the shutter at the closed position and be incapable of unlocking the shutter to maintain the closed position of the shutter, the second lock mechanism comprising:

a lock member movable in a moving direction from a stored position incapable of locking the shutter at the closed position to a lock position capable of locking the shutter at the closed position; and, a fixing portion configured to fix the lock member to the lock position.

2. The developer cartridge as claimed in claim 1, wherein the lock member includes a first protruding engagement section provided at one of the shutter and the casing and configured to protrude from one of the shutter and the casing toward the other of the shutter and the casing upon movement of the lock member toward the lock position; and wherein one of the casing and the shutter is formed with a recessed engagement portion with which the first protruding engagement section is engageable as a result of movement of the lock member toward the lock position.

3. The developer cartridge as claimed in claim 2, wherein the recessed engagement portion is configured to be non-accessible from an outside upon engagement with the first protruding engagement section to maintain locking of the shutter at the closed position.

4. The developer cartridge as claimed in claim 2, wherein the second lock mechanism further comprises a storage portion provided in one of the casing and the shutter for storing therein the lock member, the storage portion having an inner surface at which the fixing portion is provided; and wherein the lock member further includes a second protruding engagement section movable within the storage portion and disposed at a position different from the first protruding engagement section in the moving direction of the lock member; and wherein the first protruding engagement section is engageable with the fixing portion when the lock member is positioned at the stored position, and the second protruding engagement section is engageable with the fixing portion when the lock member is moved to the lock position.

5. The developer cartridge as claimed in claim 4, wherein the second lock mechanism further comprises a rest portion in the storage portion, the second protruding engagement section being engageable with the rest portion when the lock member is positioned at the stored position.

6. The developer cartridge as claimed in claim 1, wherein the first lock mechanism and the second lock mechanism are operable independently of each other.

7. The developer cartridge as claimed in claim 6, wherein the lock member includes a first protruding engagement section provided at one of the shutter and the casing and configured to protrude from one of the shutter and the casing toward the other of the shutter and the casing upon movement of the lock member toward the lock position; and wherein one of the casing and the shutter is formed with a recessed engagement portion with which the first protruding engagement section is engageable as a result of movement of the lock member toward the lock position.

8. The developer cartridge as claimed in claim 7, wherein the recessed engagement portion is configured to be non-accessible from an outside upon engagement with the first protruding engagement section to maintain locking of the shutter at the closed position.

9. The developer cartridge as claimed in claim 7, wherein the second lock mechanism further comprises a storage portion provided in one of the casing and the shutter for storing therein the lock member, the storage portion having an inner surface at which the fixing portion is provided; and wherein the lock member further includes a second protruding engagement section movable within the storage portion and disposed at a position different from the first protruding engagement section in the moving direction of the lock member; and wherein the first protruding engagement section is engageable with the fixing portion when the lock member is positioned at the stored position, and the second protruding engagement section is engageable with the fixing portion when the lock member is moved to the lock position.

10. The developer cartridge as claimed in claim 9, wherein the second lock mechanism further comprises a rest portion in the storage portion, the second protruding engagement section being engageable with the rest portion when the lock member is positioned at the stored position.

11. An image forming device comprising:

a frame;

a developer cartridge detachably mounted on the frame, the developer cartridge comprising:

a casing configured to accommodate a developing agent therein and formed with a supply opening;

a shutter movable between a closed position to close the supply opening and an open position to open the supply opening;

a first lock mechanism configured to lock the shutter at the closed position and unlock the shutter to open the supply opening; and, a second lock mechanism configured to lock the shutter at the closed position and be incapable of unlocking the shutter to maintain the closed position of the shutter, the second lock mechanism comprising:

a lock member movable in a moving direction from a stored position incapable of locking the shutter at the closed position to a lock position capable of locking the shutter at the closed position; and, a fixing portion configured to fix the lock member to the lock position;

a detecting unit configured to detect an amount of the developing agent in the casing;

a moving unit configured to forcibly move the lock member from the stored position to the lock position; and a control device configured to determine whether the developer cartridge should be replaced by a new cartridge based on an output from the detecting unit, and to drive the moving unit for moving the lock member from the stored position to the lock position when determining that the developer cartridge should be replaced.

12. A developing device comprising:

a device frame;

a developer cartridge comprising:

a casing configured to accommodate a developing agent therein and formed with a supply opening;

a shutter movable between a closed position to close the supply opening and an open position to open the supply opening;

a first lock mechanism configured to lock the shutter at the closed position and unlock the shutter to open the supply opening; and, a second lock mechanism configured to lock the shutter at the closed position and be incapable of unlocking the shutter to maintain the closed position of the shutter, the second lock mechanism comprising:

a lock member movable in a moving direction from a stored position incapable of locking the shutter at the closed position to a lock position capable of locking the shutter at the closed position; and, a fixing portion configured to fix the lock member to the lock position; and an operating portion configured to act on the second lock mechanism in association with the movement of the shutter from the closed position to the open position and allow the second lock mechanism to be moved from the stored position toward the lock position.

* * * * *